US008092969B2

(12) United States Patent
Niwa

(10) Patent No.: US 8,092,969 B2
(45) Date of Patent: Jan. 10, 2012

(54) FULL COLOR IMAGE FORMING PROCESS

(75) Inventor: Kazu Niwa, Tokyo (JP)

(73) Assignee: Zeon Corporation, Tokyo (JP)

( * ) Notice: Subject to any disclaimer, the term of this patent is extended or adjusted under 35 U.S.C. 154(b) by 919 days.

(21) Appl. No.: 12/058,832

(22) Filed: Mar. 31, 2008

(65) Prior Publication Data

US 2008/0241719 A1 Oct. 2, 2008

(30) Foreign Application Priority Data

Mar. 30, 2007 (JP) ..... 2007-091111

(51) Int. Cl.
*G03G 13/08* (2006.01)

(52) U.S. Cl. ..... 430/123.52; 430/42.1; 430/45.51; 430/123.41; 430/124.1

(58) Field of Classification Search ..... 430/42.1, 430/45.51, 123.41, 123.5, 123.52, 124.1
See application file for complete search history.

(56) References Cited

U.S. PATENT DOCUMENTS 4,957,774 A * 9/1990 Doi et al. ..... 430/108.3
5,270,138 A * 12/1993 Kaneko et al. ..... 430/47.1
6,887,637 B2 5/2005 Niwa
2005/0250033 A1 11/2005 Oyama et al.
2006/0269866 A1 11/2006 Hagino
2007/0172751 A1 7/2007 Kidokoro
2007/0254231 A1 * 11/2007 Sakamoto et al. ..... 430/109.3

FOREIGN PATENT DOCUMENTS

DE EP 1283450 * 7/2002

* cited by examiner

*Primary Examiner* — Peter Vajda

(74) *Attorney, Agent, or Firm* — Westerman, Hattori, Daniels & Adrian, LLP

(57) ABSTRACT

A process for forming a full-color image, wherein the 4 color toners each have an apparent viscosity at 105° C. of 50,000 to 300,000 Pa·s and an apparent viscosity at 130° C. of 3,000 to 30,000 Pa·s, and as a color toner arranged at the outermost layer on a transfer medium among the 4 color toners, a toner, in which a maximum peak or a shoulder peak is present between 105° C. and 130° C. in a temperature-logarithmic melt viscosity graph, is used, and as the other color toners arranged at lower layers than the outermost layer, toners, in which neither the maximum peak nor the shoulder peak is present between 105° C. and 130° C., are used.

10 Claims, 1 Drawing Sheet

FULL COLOR IMAGE FORMING PROCESS

BACKGROUND OF THE INVENTION

1. Field of the Invention

The present invention relates to a process for forming a full-color image by an electrophotographic system or an electrostatic printing system, and more particularly to a process for forming a full-color image making use of a black toner, a cyan toner, a magenta toner and a yellow toner, by which both low-temperature fixing ability and hot offset resistance are made excellent.

2. Description of the Related Art

In image forming apparatus of an electrophotographic system (including an electrostatic printing system), such as copying machines and printers using toners for development of electrostatic images, the speeding-up of printing, lowering of a fixing temperature and formation of full-color images are strongly required.

When full-color printing is conducted by using an image forming apparatus of the electrophotographic system, color spectra visible to the naked eyes are reproduced by using the principle of subtractive color mixture of three basic colors of yellow, cyan and magenta. Specifically, in the full-color printing, a yellow toner, a cyan toner and a magenta toner are used to form a full-color image. In addition to these 3 toners for full-color images, a black toner is also generally used.

The toner of each color comprises colored resin particles containing a binder resin and a colorant. Various kinds of additive components such as a charge control agent, a parting agent and a dispersing agent are contained in the colored resin particles as needed. As the colorant, is used a yellow colorant, a magenta colorant, a cyan colorant or the like. As a colorant for the black toner, is used a black colorant such as carbon black.

Toners are roughly divided into a pulverized toner by a pulverization process and a polymerized toner by a polymerization process. Examples of the polymerization process include an emulsion polymerization process, an aggregation process, a dispersion polymerization process and a suspension polymerization process. According to the polymerization process, toner particles of micron order can be directly obtained in a relatively narrow particle diameter distribution. According to the suspension polymerization process among these polymerization processes, a polymerized toner having a spherical form, a sharp particle diameter distribution and a small particle diameter can be obtained.

When a polymerizable monomer for shell is polymerized in the presence of the colored polymer particles formed by the polymerization process to cover the colored polymer particles with a polymer layer, a core-shell type toner (also referred to as "capsule toner") can be obtained. When the binder resin of the colored polymer particles, which will become core particles is formed by a polymer having a relatively low glass transition temperature, and the polymer layer, which will become a shell, is formed by a polymer having a relatively high glass transition temperature, a polymerized toner well balanced between low-temperature fixing ability and storage stability (blocking resistance) can be obtained.

As described above, the polymerized toner is excellent in image reproducibility because the particle diameter can be made small, and moreover permits low-temperature fixing and can be made hard to cause hot offset by providing the toner as the core-shell type.

When a color image is formed with the spherical toners of the core-shell type, however, cleaning using a cleaning blade is made difficult. In addition, the formation of the color image tends to more cause hot offset than the case of a monochromatic image because the color image is formed by superimposing 4 color toners on one another.

In the core-shell type toner by the polymerization process, it has heretofore been adopted to reduce the amount of a remaining monomer and the amount of a remaining organic compound, or add a parting agent, which can make the resulting toner hard to cause hot offset, into the toner.

U.S. Pat. No. 6,887,637 B2 (hereinafter referred to as "Article 1") has proposed a toner for development of electrostatic images containing at least a binder resin, a colorant and a charge control agent, in which a copolymer containing a quaternary ammonium salt group-containing (meth)acrylate monomer unit and having a glass transition temperature of 40 to 75° C. is used as the charge control agent. Article 1 also shows that the toner is provided as the core-shell type.

U.S. Patent Application Publication No. 2005/0250033 A1 (hereinafter referred to as "Article 2") shows that a magenta toner containing C.I. Pigment Red 31 and 150 in combination as magenta pigments is excellent in low-temperature fixing ability and hot offset resistance.

U.S. Patent Application Publication No. 2007/0172751 A1 (hereinafter referred to as "Article 3") discloses a toner for development of electrostatic images made up of colored resin particles containing a binder resin, a colorant and a parting agent, in which (1) the volume average particle diameter of the colored resin particles is 4 to 9 μm, (2) the average circularity of the colored resin particles is 0.93 to 0.995, (3) a shear viscosity at a temperature of 130° C. and a shearing rate of 10/sec is 3,500 to 8,000 Pa·s, (4) a shear viscosity at a temperature of 130° C. and a shearing rate of 500/sec is 300 to 1,300 Pa·s, (5) a content A of a component having a volatilizing temperature of 130° C. or lower is 100 ppm or lower, (6) a content B of a component having a volatilizing temperature higher than 130° C., but not higher than 180° C. is 100 ppm or lower, (7) A+B is 150 ppm or lower, and (8) A/B is 1.0 or smaller.

U.S. Patent Application Publication No. 2006/0269866 A1 (hereinafter referred to as "Article 4") discloses a process for producing a polymerized toner excellent in durability upon printing by containing a water-soluble polymerization inhibitor and thiuram disulfide in a dispersion liquid of a polymerizable monomer composition.

BRIEF SUMMARY OF THE INVENTION

The prior art toners disclosed in Articles 1 to 4 are excellent in low-temperature fixing ability, hot off resistance and durability upon printing. As a result of an investigation by the present inventors, however, it has been found that when a full-color image is formed with 4 color toners of a black toner, a cyan toner, a magenta toner and a yellow toner, it is difficult to balance the low-temperature fixing ability with the hot offset resistance.

In order to form the full-color image, it is necessary that development and transfer are successively conducted with the 4 color toners to form a toner image with the 4 color toners superimposed on one another on a transfer medium such as transfer paper, and the superimposed image is fixed. When the toner image having a greater thickness compared with a monochromatic image is fixed, the toner image shows a tendency to lower the offset resistance when toners excellent in low-temperature fixing ability are used. On the other hand, when toners excellent in offset resistance are used, the toner image shows a tendency to lower the low-temperature fixing ability.

Accordingly, it is an object of the present invention to provide a process for forming a full-color image making use of a black toner, a cyan toner, a magenta toner and a yellow toner, by which both low-temperature fixing ability and hot offset resistance is made excellent.

The present inventors have carried out an extensive investigation with a view toward achieving the above object. As a result, the present inventors have conceived that 4 color toners each having an apparent viscosity at 105° C. of 50,000 to 300,000 Pa·s and an apparent viscosity at 130° C. of 3,000 to 30,000 Pa·s are used, and the order of development of the respective color toners is devised in such a manner that the superimposed state of the respective color toners on a transfer medium such as transfer paper is adjusted.

Specifically, as a toner arranged at the outermost layer (outermost layer on the transfer medium) among the 4 color toners transferred to the transfer medium, a toner, in which a maximum peak or a shoulder peak is present between 105° C. and 130° C. in a temperature-logarithmic melt viscosity graph, is used, and as other toners arranged at lower layers than the outermost layer, toners, in which neither the maximum peak nor the shoulder peak is present between 105° C. and 130° C. in the temperature-logarithmic melt viscosity graph, are used.

When the process according to the present invention is adopted, an image can be formed with low-temperature fixing ability and hot offset resistance balanced with each other at a high level. The present invention has been led to completion on the basis of these findings.

According to the present invention, there is provided a process for forming a full-color image, comprising the following steps:

a development step of using 4 color toners of a black toner, a cyan toner, a magenta toner and a yellow toner to develop an electrostatic latent image corresponding to each color on one or more photosensitive members at every color, thereby forming toner images of the respective colors;

a transfer step of transferring the toner images of the respective colors to one transfer medium to form a toner image with the 4 color toners superimposed on one another on the transfer medium; and a fixing step of fixing the toner image formed on the transfer medium, wherein the 4 color toners comprise colored resin particles containing a binder resin, a colorant corresponding to each color and a parting agent and have an apparent viscosity at 105° C. of 50,000 to 300,000 Pa·s and an apparent viscosity at 130° C. of 3,000 to 30,000 Pa·s, and wherein as a color toner arranged at the outermost layer of the toner image with the 4 color toners superimposed on one another on the transfer medium among the 4 color toners, a toner, in which a maximum peak or a shoulder peak is present between 105° C. and 130° C. in a temperature-logarithmic melt viscosity graph, is used, and as the other 3 color toners arranged at lower layers than the outermost layer, toners, in which neither the maximum peak nor the shoulder peak is present between 105° C. and 130° C., are used.

DETAILED DESCRIPTION OF THE INVENTION

Figure 1:
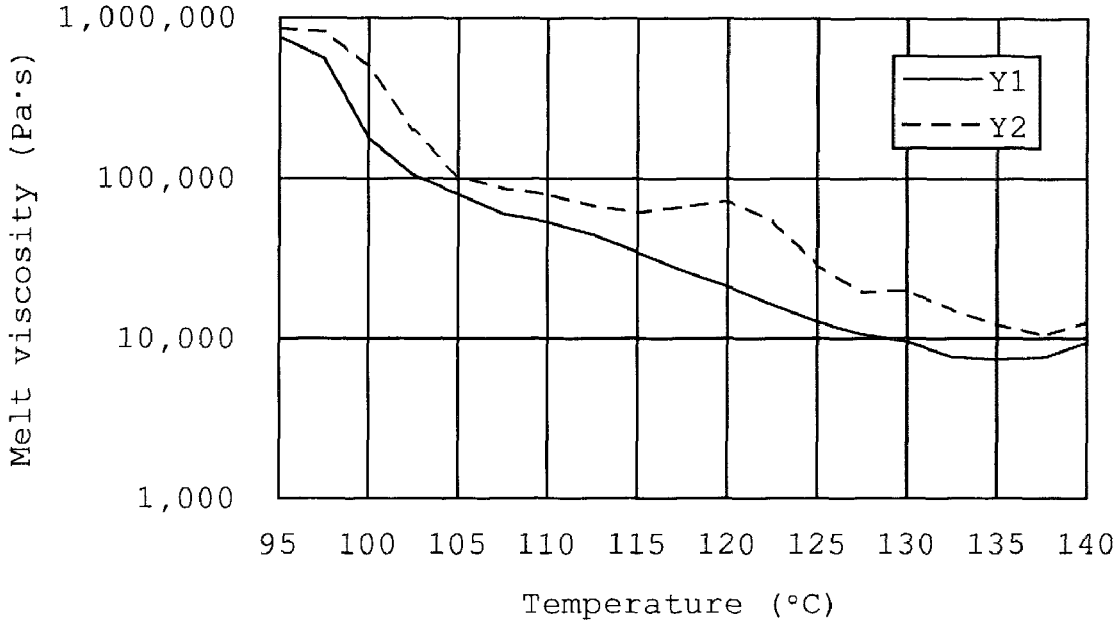
FIG. 1 is a temperature-logarithmic melt viscosity graph of yellow toners Y1 and Y2 respectively prepared in Toner Preparation Examples 1 and 5.

The image forming process according to the present invention is a process for forming a full-color image, which include conducting a development step of using a black toner, a cyan toner, a magenta toner and a yellow toner, which comprise colored resin particles containing at least a binder resin, a colorant and a parting agent, to successively develop electrostatic latent images on a photosensitive member, and a transfer step of transferring the toner images on the photosensitive member to a transfer medium, and then conducting a fixing step of fixing a toner image with the 4 colors superimposed on one another, which has been formed on the transfer medium. Before or after these respective steps, an image exposure step, an intermediate transfer step making use of an intermediate transfer drum or belt, and a cleaning step are arranged as needed.

In high-speed full-color printing, 4 photosensitive members are generally used to develop an electrostatic latent image corresponding to each color on each of the photosensitive members at every color, thereby forming toner images of the respective colors. The toner images of the respective colors on the respective photosensitive members are successively transferred to one transfer medium.

As another system, there is a system that one photosensitive member is used to successively develop electrostatic latent images on the photosensitive member at every color, the toner images of the respective colors are then successively transferred to an intermediate transfer drum to form a toner image with the 4 color toners superimposed on one another on the intermediate transfer medium, and the toner image is transferred to one transfer medium.

In the present invention, as the 4 color toners, are used toners each having an apparent viscosity at 105° C. of 50,000 to 300,000 Pa·s, preferably 60,000 to 250,000 Pa·s, more preferably 70,000 to 200,000 Pa·s and an apparent viscosity at 130° C. of 3,000 to 30,000 Pa·s, preferably 4,000 to 25,000 Pa·s, more preferably 5,000 to 20,000 Pa·s. The apparent viscosity at each temperature of each color toner falls within the above range, whereby lowering of storage stability and hot offset resistance can be prevented.

In the image forming process according to the present invention, as a toner arranged at the outermost layer (outermost layer of the image toner on the transfer medium) among the 4 color toners transferred to the transfer medium, a toner, in which a maximum peak or a shoulder peak is present between 105° C. and 130° C. in a temperature-logarithmic melt viscosity graph, is used, and as other 3 color toners arranged at lower layers than the outermost layer, toners, in which neither the maximum peak nor the shoulder peak is present between 105° C. and 130° C. in the temperature-logarithmic melt viscosity graph, are used.

The toner, in which the maximum peak or the shoulder peak is present between 105° C. and 130° C. in the temperature-logarithmic melt viscosity graph, is excellent in hot offset resistance. When toners, in which the maximum peak or the shoulder peak is present between 105° C. and 130° C., are used for all the 4 color toners, however, the low-temperature fixing ability becomes insufficient. The toner, in which neither the maximum peak nor the shoulder peak is present between 105° C. and 130° C. in the temperature-logarithmic melt viscosity graph, is excellent in low-temperature fixing ability. When toners, in which neither the maximum peak nor the shoulder peak is present between 105° C. and 130° C., are used for all the 4 color toners, however, the hot offset resistance is lowered.

A toner, in which the maximum peak or the shoulder peak is present between 105° C. and 130° C., is used for only the toner of the outermost layer among the 4 color toner layers on the transfer medium, and toners, in which neither the maximum peak nor the shoulder peak is present between 105° C.

and 130° C., are used for the 3 color toners located at lower layers than the outermost layer, whereby the low-temperature fixing ability and the hot offset resistance can be balanced with each other at a high level.

Whether the maximum peak or the shoulder peak is present between 105° C. and 130° C. in the temperature-logarithmic melt viscosity graph or not can be determined by measuring an apparent viscosity of a toner sample within a temperature range of 95 to 140° C. by means of a flow tester, and plotting the resultant measured values on a graph that the logarithm of the apparent viscosity (i.e., melt viscosity) and the temperature are taken on an axis of ordinate and an axis of abscissa, respectively. The details of the measuring method are described in Examples.

As shown in FIG. 1, with respect to "Yellow Toner Y1" obtained in Toner Preparation Example 1, neither a maximum peak nor a shoulder peak is present between 105° C. and 130° C. in the temperature-logarithmic melt viscosity graph. On the other hand, with respect to "Yellow Toner Y2" obtained in Toner Preparation Example 5, a maximum peak or a shoulder peak is present between 105° C. and 130° C. in the temperature-melt viscosity graph. As a method for producing such 2 kinds of toners, is mentioned a method in which the kind and amount of a molecular weight modifier used are controlled.

Figure 2:
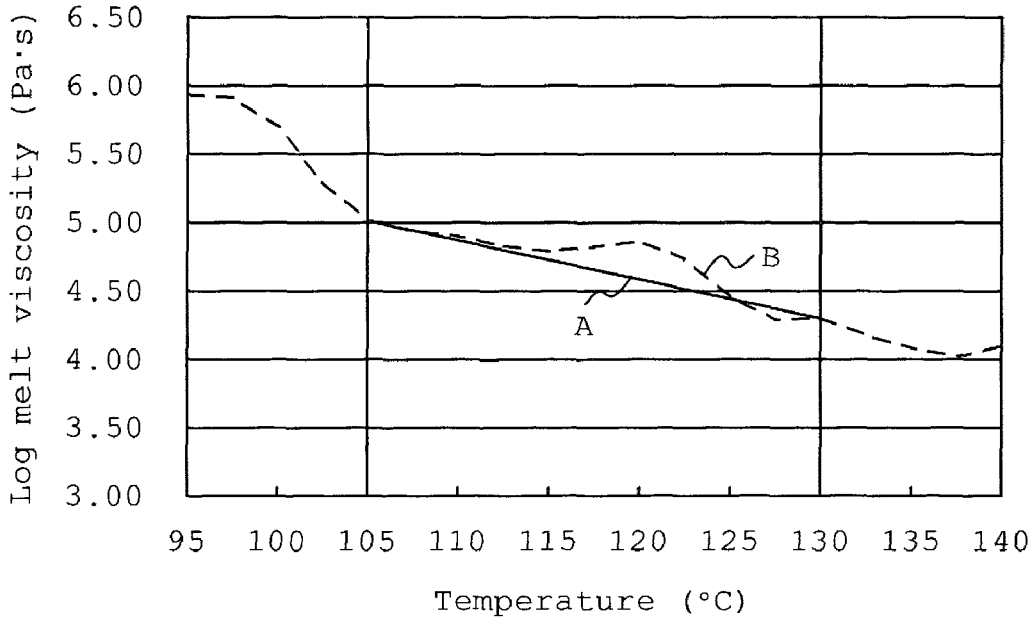
FIG. 2 is a temperature-logarithmic melt viscosity graph of the yellow toner Y2 prepared in Toner Preparation Example 5.

As shown in FIG. 2, from a straight line A linking a melt viscosity value at 105° C. with a melt viscosity value at 130° C. of the toner in the range of 105 to 130° C. in the temperature-logarithmic melt viscosity graph and a curve B exhibited by the toner, a maximum value of a difference between the log(melt viscosity Pa·s) of the curve B and the log(melt viscosity Pa·s) of the straight line A can be determined. The temperature-logarithmic melt viscosity graph was prepared by plotting the logarithmic value of the apparent viscosity at intervals of 2.5° C. against the temperature.

As shown in FIG. 2, the maximum peak temperature of the curve B is 120° C., and the logarithmic value log(melt viscosity Pa·s) of the melt viscosity of "Yellow Toner Y2" at that temperature is 4.86. In "Yellow Toner Y2" shown in FIG. 2, the formula of the straight line linking the melt viscosity 103,000 Pa·s at 105° C. with the melt viscosity 20,000 at 130° C. is represented by $y=-0.028x+7.94$. When a melt viscosity at 120° C. is found from this formula, the log(melt viscosity Pa·s) at 120° C. of the straight line A is 4.58. A difference (4.86−4.58) between both logarithmic values is 0.28.

In each color toner used in the present invention, a maximum value of a difference between [log(melt viscosity Pa·s) of the curve B] and [log(melt viscosity Pa·s) of the straight line A] is preferably 0.1 or greater, more preferably 0.15 or greater, still more preferably 0.2 or greater. The upper limit value of the maximum value of this difference is of the order of about 0.5 or 0.4. The maximum value of this difference preferably falls within the above range because the fact that a maximum peak or a shoulder peak is present between 105° C. and 130° C. is clarified, and moreover the low-temperature fixing ability and the hot offset resistance can be balanced with each other at a high level. The gradient of the straight line linking the logarithmic melt viscosities (Pa·s) at the respective temperatures of 105° C. and 130° C. with each other is preferably −0.06 or smaller, more preferably −0.05 or smaller, still more preferably −0.04 or smaller.

Each color toner used in the present invention according to the present invention is not particularly limited by a production process thereof so far as it is composed of colored resin particles including a binder resin, a colorant and a parting agent. The colored resin particles are also called toner, and may be called colored polymer particles in the case of a polymerized toner. Examples of a production process of the toner include a pulverization process and a polymerization process. Examples of the polymerization process include an emulsion polymerization process, an aggregation process, a dispersion polymerization process and a suspension polymerization process. According to the polymerization process, toner of micron order can be directly obtained in a relatively narrow particle diameter distribution. Each color toner used in the present invention may also be a core-shell type toner (also referred to as "capsule toner") that a coating resin layer is formed on each surface of the colored resin particles. Each color toner used in the present invention is particularly preferably a polymerized toner obtained by the suspension polymerization process from the viewpoint of developer properties.

The polymerized toner by the suspension polymerization process can be obtained by subjecting a polymerizable monomer composition containing at least a polymerizable monomer, a colorant and a parting agent to suspension polymerization in an aqueous dispersion medium containing a dispersion stabilizer. A polymer formed by the polymerization of the polymerizable monomer will become a binder resin. A polymerized toner having a core-shell structure can be produced in accordance with a spray drying process, interface reaction process, in situ polymerization process, phase separation process or the like. The in situ polymerization process and phase separation process are particularly preferred in that production efficiency is good. Specifically, the polymerized toner having the core-shell structure can be obtained by using, as core, colored resin particles obtained by subjecting a polymerizable monomer composition containing at least a polymerizable monomer, a colorant and a parting agent to suspension polymerization in an aqueous dispersion medium containing a dispersion stabilizer, and subjecting a polymerizable monomer for shell to suspension polymerization in the presence of the core. A polymer layer formed by polymerization of the polymerizable monomer for shell will become a coating resin layer (shell). The polymerizable monomer composition may contain various kinds of additives such as a charge control agent, a crosslinkable monomer, a macromonomer, a molecular weight modifier, a lubricant and a dispersion aid as needed. In particular, the molecular weight modifier fulfills the important role of controlling toner properties.

As the polymerizable monomer, is preferred a monovinyl monomer. Specific examples thereof include styrenic monomers such as styrene, vinyltoluene and α-methylstyrene; acrylic acid and methacrylic acid; derivatives of acrylic acid or methacrylic acid, such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonitrile, methacrylonitrile, acrylamide and methacrylamide; ethylenically unsaturated monoolefins such as ethylene, propylene and butylene; vinyl halides such as vinyl chloride, vinylidene chloride and vinyl fluoride; vinyl esters such as vinyl acetate and vinyl propionate; vinyl ethers such as vinyl methyl ether and vinyl ethyl ether; vinyl ketones such as vinyl methyl ketone and methyl isopropenyl ketone; and nitrogen-containing vinyl compounds such as 2-vinylpyridine, 4-vinylpyridine and N-vinyl-pyrrolidone. The monovinyl monomers may be used either singly or in any combination thereof. Among the monovinyl monomers, a styrenic monomer and a derivative of (meth)acrylic acid are preferably used in combination.

When a crosslinkable monomer and/or a crosslinkable polymer is used together with the polymerizable monomer, the hot offset resistance of the resulting toner can be effectively improved. The crosslinkable monomer is a monomer having two or more polymerizable carbon-carbon unsaturated double bonds. As examples thereof, may be mentioned aromatic divinyl compounds such as divinylbenzene, divinylnaphthalene and derivatives thereof; di-ethylenically unsaturated carboxylic acid esters such as ethylene glycol dimethacrylate and diethylene glycol dimethacrylate; (meth) acrylates derived from aliphatic both-terminal alcohols such as 1,4-butanediol and 1,9-nonanediol; divinyl compounds such as N,N-divinylaniline and divinyl ether; and compounds having three or more vinyl groups.

As examples of the crosslinkable polymer, may be mentioned (meth)acrylates having two or more hydroxyl groups in their molecules and derived from polyethylene, polypropylene, polyester and polysiloxane. These crosslinkable monomers and crosslinkable polymers may be used either singly or in any combination thereof. The crosslinkable monomer and/or the crosslinkable polymer is used in a proportion of generally at most 10 parts by weight, preferably 0.01 to 5 parts by weight, more preferably 0.1 to 2 parts by weight per 100 parts by weight of the polymerizable monomer.

When a macromonomer is used together with the polymerizable monomer, a balance between storage stability or offset resistance and low-temperature fixing ability of the resulting toner can be improved. The macromonomer is a relatively long-chain linear molecule having a polymerizable functional group (for example, an unsaturated group such as a carbon-carbon double bond) at its molecular chain terminal. The macromonomer is preferably an oligomer or polymer having a number average molecular weight of generally 1,000 to 30,000. When a macromonomer having a low number average molecular weight is used, the surface portions of the resulting toner particles become soft, whereby the storage stability of the toner is deteriorated. When a macromonomer having a high number average molecular weight is used on the other hand, the melt property of such a macromonomer is poor, resulting in a toner deteriorated in fixing ability.

As specific examples of the macromonomer, may be mentioned polymers obtained by polymerizing styrene, styrene derivatives, methacrylic esters, acrylic esters, acrylonitrile and methacrylonitrile either singly or in combination of two or more monomers thereof; macromonomers having a polysiloxane skeleton. Among the macromonomers, polymers having a glass transition temperature higher than the glass transition temperature of the binder resin are preferred, with copolymer macromonomers of styrene and a methacrylic ester and/or an acrylic ester, and poly(methacrylic ester) macromonomers being particularly preferred. When the macromonomer is used, it is used in a proportion of generally 0.01 to 10 parts by weight, preferably 0.03 to 5 parts by weight, more preferably 0.05 to 1 part by weight per 100 parts by weight of the polymerizable monomer. If the proportion of the macromonomer used is too high, the resulting toner shows a tendency to lower fixing ability.

As the colorant, may be used any of various kinds of pigments and dyes used in the field of toners, such as carbon black and titanium white. As examples of black colorants, may be mentioned dyes and pigments such as carbon black and Nigrosine Base; and magnetic powders such as cobalt, nickel, triiron tetroxide, manganese iron oxide, zinc iron oxide and nickel iron oxide. When carbon black is used, that having a primary particle diameter of 20 to 40 nm is preferably used in that the resulting toner can provide images good in image quality, and the safety of the toner in environment is enhanced.

As colorants for color toners, may be used yellow colorants, magenta colorants, cyan colorants, etc. Examples of the yellow colorants include C.I. Pigment Yellow 3, 12, 13, 14, 15, 17, 62, 65, 73, 74, 83, 90, 93, 97, 120, 138, 155, 180 and 181; Naphthol Yellow S, Hansa Yellow G, and C.I. Vat Yellow.

Examples of the magenta colorants include azo pigments, fused polycyclic pigments, etc., and specific examples thereof include C.I. Pigment Red 48, 57, 58, 60, 63, 64, 68, 81, 83, 87, 88, 89, 90, 112, 114, 122, 123, 144, 146, 149, 163, 170, 184, 185, 187, 202, 206, 207, 209 and 251; C.I. Pigment Violet 19; and C.I. Pigment Magenta 31 and 150.

Examples of the cyan colorants include copper phthalocyanine compounds and derivatives thereof, and anthraquinone compounds, and specific examples thereof include C.I. Pigment Blue 2, 3, 6, 15, 15:1, 15:2, 15:3, 15:4, 16, 17 and 60; Phthalocyanine Blue, C.I. Vat Blue, and C.I. Acid Blue. The colorants are used in a proportion of generally 0.1 to 50 parts by weight, preferably 1 to 20 parts by weight per 100 parts by weight of the binder resin or the polymerizable monomer forming the binder resin.

As examples of the molecular weight modifier, may be mentioned mercaptans such as t-dodecylmercaptan, n-dodecylmercaptan and n-octylmercaptan; halogenated hydrocarbons such as carbon tetrachloride and carbon tetrabromide; and thiumram disulfides such as tetraethylthiuram disulfide. These molecular weight modifiers may be added before the initiation of the polymerization or in the course of the polymerization. The molecular weight modifier is used in a proportion of generally 0.01 to 10 parts by weight, preferably 0.1 to 5 parts by weight per 100 parts by weight of the polymerizable monomer.

A lubricant, such as a fatty acid such as oleic acid or stearic acid, or a fatty acid metal salt composed of a fatty acid and a metal such as Na, K, Ca, Mg or Zn; and/or a dispersion aid such as a silane or titanium coupling agent may be used for uniformly dispersing the colorant in the resulting toner. Such lubricant and dispersion aid are each used in a proportion of generally about 1/1,000 to 1/1 based on the weight of the colorant.

In order to improve the charge property of the resulting toner, various kinds of charge control agents having positively charging ability or negatively charging ability are used. Examples of usable charge control agents include charge control agents such as BONTRON N01 (product of Orient Chemical Industries Ltd.), NIGROSINE BASE EX (product of Orient Chemical Industries Ltd.), SPIRON BLACK TRH (product of Hodogaya Chemical Co., Ltd.), T-77 (product of Hodogaya Chemical Co., Ltd.), BONTRON S-34 (product of Orient Chemical Industries Ltd.), BONTRON E-81 (product of Orient Chemical Industries Ltd.), BONTRON E-84 (product of Orient Chemical Industries Ltd.), BONTRON E-89 (product of Orient Chemical Industries Ltd.), BONTRON F-21 (product of Orient Chemical Industries Ltd.), COPY CHRGE NX VP434 (product of Clariant Co.), COPY CHRGE NXG VP2036 (product of Clariant Co.), TNS-4-1 (product of Hodogaya Chemical Co., Ltd.), TNS-4-2 (product of Hodogaya Chemical Co., Ltd.) and LR-147 (product of The Japan Carlit Co., Ltd.); and charge control resins such as quaternary ammonium (salt) group-containing copolymers described in, for example, Japanese Patent Application Laid-Open Nos. 11-15192, 3-175456 and 3-243954, and sulfonic (salt) group-containing copolymers described in, for example, Japanese Patent Application Laid-Open Nos. 3-243954, 1-217464 and 3-15858. The charge control agent is used in a proportion of generally 0.01 to 10 parts by weight, preferably 0.1 to 7 parts by weight per 100 parts by weight of the binder resin or the polymerizable monomer forming the binder resin.

Examples of the parting agent include low molecular weight polyolefin waxes such as low molecular weight polyethylene, low molecular weight polypropylene and low molecular weight polybutylene; terminal-modified polyolefin waxes such as molecule terminal-oxidized low molecular weight polypropylene, molecular terminal-modified low molecular weight polypropylene substituted by an epoxy group at its molecular terminal and block polymers of these compounds with low molecular weight polyethylene, and molecule terminal-oxidized low molecular weight polyethylene, molecular terminal-modified low molecular weight polyethylene substituted by an epoxy group at its molecular terminal and block polymers of these compounds with low molecular weight polypropylene; vegetable natural waxes such as candelilla wax, carnauba wax, rice wax, Japan wax and jojoba wax; petroleum waxes such as paraffin wax, microcrystalline wax and petrolatum, and modified waxes thereof; mineral waxes such as montan, ceresin and ozokerite; synthetic waxes such as Fischer-Tropsch wax; fatty acid ester compounds of polyhydric alcohols; and mixtures thereof.

Among the parting agents, the fatty acid ester compounds of polyhydric alcohols are preferred because the low-temperature fixing ability of the resulting toner is improved, and durability upon printing is not deteriorated. Examples of the fatty acid ester compounds of polyhydric alcohols include pentaerythritol esters such as pentaerythritol tetramyristate, pentaerythritol tetrapalmitate, pentaerythritol tetrastearate and pentaerythritol tetralaurate; dipentaerythritol esters such as dipentaerythritol hexamyristate, dipentaerythritol hexapalmitate and dipentaerythritol hexylaurate; and fatty acid ester compounds of polyglycerol. Among the fatty acid ester compounds of polyhydric alcohols, the fatty acid ester compounds of polyglycerol are particularly preferred. The parting agent is preferably used in a proportion of 0.1 to 20 parts by weight, more preferably 1 to 15 parts by weight per 100 parts by weight of the binder resin or the polymerizable monomer forming the binder resin.

As the polymerization initiator, is preferably used a radical polymerization initiator. Specific examples thereof include persulfates such as potassium persulfate and ammonium persulfate; azo compounds such as 4,4'-azobis(4-cyanovaleric acid), 2,2'-azobis(2-amidino-propane) bihydrochloride, 2,2'-azobis-2-methyl-N-1,1-bis(hydroxymethyl)-2-hydroxyethylpropionamide, 2,2'-azobis(2,4-dimethylvaleronitrile), 2,2'-azobis-isobutyronitrile and 1,1'-azobis(1-cyclohexane-carbonitrile); diacyl peroxides such as isobutyryl peroxide, 2,4-dichlorobenzoyl peroxide and 3,5,5'-trimethylhexanoyl peroxide; peroxy dicarbonates such as bis(4-t-butyl-cyclohexyl)peroxy dicarbonate, di-n-propylperoxy dicarbonate, diisopropylperoxy dicarbonate, di-2-ethoxy-ethylperoxy dicarbonate, di(2-ethylethylperoxy) dicarbonate, dimethoxybutylperoxy dicarbonate and di(3-methyl-3-methoxy-butylperoxy) dicarbonate; and other peroxides such as (α,α-bis-neodecanoylperoxy)diisopropylbenzene, cumylperoxy neodecanoate, 1,1',3,3'-tetramethylbutylperoxy neodecanoate, 1-cyclohexyl-1-methylethylperoxy neodecanoate, t-hexyl-peroxy neodecanoate, t-butylperoxy neodecanoate, t-hexyl-peroxy pivalate, t-butylperoxy pivalate, methyl ethyl peroxide, di-t-butyl peroxide, acetyl peroxide, dicumyl peroxide, lauroyl peroxide, benzoyl peroxide, t-butyl-peroxy-2-ethyl hexanoate, di-isopropylperoxy dicarbonate, di-t-butylperoxy isophthalate and t-butylperoxy isobutyrate. Redox initiators composed of combinations of these polymerization initiators with a reducing agent may also be used.

Among these polymerization initiators, oil-soluble radical polymerization initiators soluble in the polymerizable monomer are preferred. A water-soluble initiator may also be used in combination therewith as needed. The proportion of the polymerization initiator used is generally 0.1 to 20 parts by weight, preferably 0.3 to 15 parts by weight, more preferably 0.5 to 10 parts by weight per 100 parts by weight of the polymerizable monomer. If this proportion used is too low, the rate of polymerization becomes slow. If the proportion is too high, the molecular weight of the resulting polymer becomes low. It is hence not preferred to use the polymerization initiator in such a too low or high proportion. Although the polymerization initiator may be added into the polymerizable monomer composition in advance, it may also be added into the suspension after completion of the step of forming droplets of the polymerizable monomer composition in the aqueous dispersion medium for the purpose of avoiding premature polymerization.

As examples of the dispersion stabilizer used in the present invention, may be mentioned sulfates such as barium sulfate and calcium sulfate; carbonates such as barium carbonate, calcium carbonate and magnesium carbonate; phosphates such as calcium phosphate; metal oxides such as aluminum oxide and titanium oxide; metal hydroxides such as aluminum hydroxide, magnesium hydroxide and ferric hydroxide; water-soluble polymers such as polyvinyl alcohol, methyl cellulose and gelatin; and surfactants such as anionic surfactants, nonionic surfactants and amphoteric surfactants. Among these, metal compounds such as the sulfates, carbonates, metal oxides and metal hydroxides are preferred, with colloid of hardly water-soluble metal compounds being more preferred. In particular, colloid of a hardly water-soluble metal hydroxide is suitable for use because the particle diameter distribution of the resulting toner particles can be narrowed, and the brightness or sharpness of an image formed from such a toner is improved.

The colloid of the hardly water-soluble metal hydroxide is not limited by the production process thereof. However, it is preferred to use colloid of a hardly water-soluble metal hydroxide obtained by adjusting the pH of an aqueous solution of a water-soluble polyvalent metal compound to 7 or higher, in particular, colloid of a hardly water-soluble metal hydroxide formed by reacting a water-soluble polyvalent metal compound with an alkali metal hydroxide in an aqueous phase. The colloid of the hardly water-soluble metal hydroxide preferably has number particle diameter distributions, $D_{50}$ (50% cumulative value of number particle diameter distribution) of at most 0.5 μm and $D_{90}$ (90% cumulative value of number particle diameter distribution) of at most 1 μm. If the particle diameter of the colloid is too great, the stability of the polymerization reaction is broken, and the storage stability of the resulting toner is deteriorated.

The dispersion stabilizer is used in a proportion of preferably 0.1 to 20 parts by weight, more preferably 0.3 to 10 parts by weight per 100 parts by weight of the polymerizable monomer. If this proportion used is too low, it is difficult to achieve sufficient polymerization stability, so that polymer aggregates are liable to be formed. If this proportion is too high on the other hand, the particle diameter distribution of the resulting toner particles is widened due to increase in fine particles, and the viscosity of the aqueous solution is increased, so that polymerization stability is lowered.

In order to produce colored resin particles (colored polymer particles) by the suspension polymerization process, a polymerizable monomer, a colorant and other additive components are first mixed to prepare a polymerizable monomer composition. The polymerizable monomer composition is then poured into an aqueous medium containing a dispersion stabilizer, and the resultant suspension is stirred under high shearing force by means of a high-speed stirrer or the like to form minute droplets of the polymerizable monomer composition in the aqueous medium.

In the formation of the droplets of the polymerizable monomer composition, primary droplets having a volume average droplet diameter of about 50 to 1,000 μm are first formed. In order to avoid premature polymerization, a polymerization initiator is preferably added to the aqueous dispersion medium after the size of the primary droplets in the aqueous medium becomes uniform. The polymerization initiator is added and mixed into the suspension with the primary droplets of the polymerizable monomer composition dispersed in the aqueous dispersion medium, and the resultant mixture is stirred by means of a high-speed rotating and shearing type agitator until the droplet diameter of the droplets becomes a small diameter near to the intended particle diameter of the colored polymer particles. In such a manner, secondary droplets having a fine volume average droplet diameter of about 2 to 15 μm are formed.

No particular limitation is imposed on the method for forming the droplets. However, the formation is conducted by means of, for example, a device capable of strongly stirring, such as an (in-line type) emulsifying and dispersing machine (manufactured by Ebara Corporation, trade name "MILDER") or a high-speed emulsifying and dispersing machine (manufactured by Tokushu Kika Kogyo Co., Ltd., trade name "T.K. HOMOMIXER MARK II Type").

The polymerizable monomer composition dispersed in the form of droplets in the aqueous medium is polymerized in the presence of the polymerization initiator to form colored polymer particles. The polymerization temperature is generally at least 50° C., preferably 60 to 95° C. The polymerization reaction is conducted for generally 1 to 20 hours, preferably 2 to 15 hours. The aqueous dispersion liquid containing the colored polymer particles formed is filtered, and the resultant filter cake is subjected to respective steps of washing, dehydration and drying to collect the colored polymer particles.

The polymerizable monomer(s) used for forming the colored polymer particles may desirably be selected in such a manner that the glass transition temperature Tg of a polymer obtained by polymerizing it or them is generally 80° C. or lower, preferably 40 to 80° C., more preferably 50 to 70° C. The polymerizable monomers are used either singly or in combination of 2 or more monomers thereof, whereby the glass transition temperature of a polymer formed can be controlled within a desired range.

In the case of the core-shell type colored polymer particles, the glass transition temperature of a polymer forming a shell is preferably higher, more preferably higher by at least 5° C., particularly preferably higher by at least 10° C. than the glass transition temperature of the polymer forming the colored polymer particles as core particles. As polymerizable monomers for shell, are preferred styrene, methyl methacrylate, acrylonitrile and mixtures thereof, which are capable of forming a polymer having a high glass transition temperature exceeding 80° C. The upper limit of the glass transition temperature is 110° C., often 105° C.

As examples of polymerization initiators used in the polymerization of the polymerizable monomer(s) for shell, may be mentioned water-soluble polymerization initiators, such as persulfates such as potassium persulfate and ammonium persulfate; and azo type initiators such as 2,2'-azobis[2-methyl-N-(2-hydroxyethyl)propionamide] and 2,2'-azobis-[2-methyl-N-[1,1-bis(hydroxymethyl)-2-hydroxyethyl] propionamide]. The amount of the polymerization initiator added is preferably 0.1 to 30 parts by weight, more preferably 1 to 20 parts by weight per 100 parts by weight of the polymerizable monomer for shell. The polymerization temperature of the polymerizable monomer for shell is preferably at least 50° C., more preferably 60 to 95° C. The polymerization reaction is conducted for preferably 1 to 20 hours, more preferably 2 to 15 hours.

Since the aqueous dispersion liquid containing the colored polymer particles (including core-shell type) formed by the polymerization contains the dispersion stabilizer, a great number of fine particles of the dispersion stabilizer adheres to the surfaces of the colored polymer particles. When an inorganic compound soluble in an acid, such as an inorganic hydroxide, is used as the dispersion stabilizer, the acid is added into the aqueous dispersion liquid containing the colored polymer particles formed to dissolve the dispersion stabilizer in water, thereby removing the dispersion stabilizer. When the dispersion stabilizer is an inorganic compound soluble in an alkali, the alkali is added into the aqueous dispersion liquid containing the colored polymer particles to dissolve the dispersion stabilizer in water, thereby removing the dispersion stabilizer.

For example, when colloid of a hardly water-soluble metal hydroxide, such as colloid of magnesium hydroxide, is used as the dispersion stabilizer, an acid such as sulfuric acid is added into the aqueous dispersion liquid to solubilize the dispersion stabilizer in water (this process is referred to as "acid washing"). The pH of the aqueous dispersion liquid is adjusted to generally 6.5 or lower, preferably 2 to 6.5, more preferably 3 to 6.0 by the acid washing. As the acid added, may be used an inorganic acid such as sulfuric acid, hydrochloric acid or nitric acid, or an organic acid such as formic acid or acetic acid.

The aqueous dispersion liquid obtained in the acid washing or alkali washing step is filtered to separate the colored polymer particles. The colored polymer particles separated by filtration are then washed with water, and the washing water is filtered. In the water washing step, it is preferable that the colored polymer particles be washed with water until the electric conductivity of a filtrate (washing water filtered) is lowered to at most 1,000 μS/cm, and the washing water be filtered. The water washing step may be conducted repeatedly by a batch system or continuously by means of a belt filter or the like. As a washing device used in the water washing, may be used, for example, any one of a belt filter, a rotary filter and a filter press or a combination of plural devices thereof. After the washing step, the colored polymer particles in the wetted state are dehydrated in a dehydration step and then dried.

The volume average particle diameter (Dv) of the toner (including core-shell type colored resin particles) used in the image forming process according to the present invention is generally 3 to 12 μm, preferably 4 to 11 μm, more preferably 5 to 10 μm. The particle diameter distribution of the toner particles according to the present invention, which is represented by a ratio (Dv/Dp) of the volume average particle diameter (Dv) to the number average particle diameter (Dp), is generally at least 1, preferably at most 1.4, particularly preferably at most 1.3. If the volume average particle diameter of the toner particles is too great, such a toner is liable to deteriorate the resolution of an image formed with the toner. If the particle diameter distribution of the toner particles is too wide, a proportion of toner particles having a great particle diameter becomes high, so that such a toner is liable to deteriorate the resolution.

The average circularity of the toner particles used in the image forming process according to the present invention is preferably 0.960 to 0.995, more preferably 0.970 to 0.990. If the average circularity of the toner particles is too low, such a toner is liable to lower the flowability and transferability thereof. If the average circularity of the toner particles is too high, such a toner shows a tendency to lower the ability to clean the toner remaining on a photosensitive member. The average circularity of the toner particles falls within the above-described range, whereby the flowability, transferability and cleaning ability of the toner can be balanced with one another at a high level.

The average circularity can be determined by a ratio ($L_1/L_2$) of a peripheral length $L_1$ of a circle having the same area as the projected area of a particle to a peripheral length $L_2$ of a projected image of such a particle. The average circularity is an average value of circularities of toner particles obtained by conducting measurement on particles having a circle-equivalent diameter of 0.6 to 400 μm. The measurement of the average circularity can be conducted by means of a Flow Particle Image Analyzer. The average circularity is an index indicating the degree of irregularities of the shapes of the toner particles, and the average circularity is 1 where the toner particles are in the form of a complete circle, and becomes a smaller value as the shapes of the toner particles become more complicated.

The average thickness of the shell in the core-shell type toner particles is generally 0.001 to 1 μm, preferably 0.003 to 0.5 μm, more preferably 0.005 to 0.2 μm, particularly preferably 0.02 to 0.05 μm (20 to 50 nm). If the thickness of the shell is too great, the fixing ability of such a toner is deteriorated. If the thickness is too small, the storage stability of such a toner is deteriorated. The particle diameters of the core particles and the thickness of the shell in the polymerized toner can be determined by directly measuring the size and shell thickness of each of particles selected at random from electron photomicrographs thereof when they can be observed through an electron microscope. If the core and shell in each particle are difficult to distinctively observe through the electron microscope, the thickness of the shell can be calculated out from the volume average particle diameter of the core particles and the amount of the polymerizable monomer used for forming the shell.

The process for forming the core-shell structure in the case of a polymerized toner is preferably a process (in situ polymerization process), in which the colored resin particles are used as core particles, and a polymerizable monomer for shell is polymerized in the presence of the core particles, thereby forming a polymer layer (shell) on each of the surfaces of the core particles.

In the toner used in the image forming process according to the present invention, the content of volatile organic compounds in the toner is preferably at most 500 ppm, more preferably at most 300 ppm, still more preferably at most 100 ppm. If the content of the volatile organic compounds exceeds the above range, hot offset may be liable to occur in some cases. In addition, such a toner tends to emit odor upon fixing of the toner.

The toner used in the image forming process according to the present invention is low in fixing temperature and excellent in continuously printing ability after storage at a high temperature and prevents a developing roll from being whitened. The toner used in the image forming process according to the present invention has a degree of aggregation of preferably at most 10% by weight, more preferably at most 5% by weight, particularly preferably at most 2% by weight after storage for 6 hours at 62.5° C., and is thus excellent in blocking resistance at a high temperature.

When the toner used in the image forming process according to the present invention is used as a non-magnetic one-component developer, external additives are preferably mixed into the toner particles (colored resin particles) to provide each color toner. As the external additives, may be mentioned inorganic fine particles and organic fine resin particles that act as a flowability-improving agent and an abrasive. Examples of the inorganic fine particles include fine particles of silicon dioxide (silica), aluminum oxide (alumina), titanium oxide, zinc oxide, tin oxide, barium titanate, strontium titanate, etc. Examples of the organic fine resin particles include fine particles of methacrylic ester polymers, acrylic ester polymers, styrene-methacrylic ester copolymers and styrene-acrylic ester copolymers, and core-shell type particles in which the core is formed by a methacrylic ester polymer, and the shell is formed by a styrene polymer.

Among these, the inorganic fine particles are preferred, with silicon dioxide particles being particularly preferred. The surfaces of the inorganic fine particles may be subjected to a hydrophobicity-imparting treatment. Fine silicon dioxide particles subjected to the hydrophobicity-imparting treatment are particularly preferred. Two or more of the external additives may be used in combination. When the external additives are used in combination, it is preferable to use two kinds of inorganic fine particles different in average particle diameter from each other, or inorganic fine particles and organic fine resin particles in combination. No particular limitation is imposed on the amount of the external additives added. However, it is generally 0.1 to 6 parts by weight per 100 parts by weight of the toner particles. The adhesion of the external additives to the toner particles is generally conducted by charging the toner particles and external additives into a mixer such as a Henschel mixer to stir them.

A full-color image is then formed by a process including conducting a development step 1 of a multiple development system of using the black toner, cyan toner, magenta toner and yellow toner, which comprise colored resin particles produced as described above and containing at least the binder resin, the colorant and the parting agent, to successively develop electrostatic latent images on a photosensitive member, and a transfer step 2 of transferring the toner images on the photosensitive member to a transfer medium, and then conducting a fixing step 3 of fixing a toner image with the 4 colors superimposed on one another, which has been formed on the transfer medium. Before or after these respective steps, an image exposure step, a cleaning step and the like are arranged.

In the development step 1, a charging means and a developing means for every toner are arranged around the photosensitive drum, and multiple developments of electrostatic latent images with all the toners are successively conducted on the photosensitive drum. In this case, the image exposure step is conducted at every toner.

Examples of the order of the developments with the respective toners in the development step 1 of this multiple development system include the order of the black toner, the cyan toner, the magenta toner and the yellow toner; and the order of the yellow toner, the cyan toner, the magenta toner and the black toner. However, the developments may be conducted in other orders. The toner used in the last development in the development step is arranged at the outermost layer on the transfer medium.

EXAMPLES

The present invention will hereinafter be described more specifically by the following Examples and Comparative Examples. However, the present invention is not limited to only these examples. All designations of "part" or "parts" and "%" as will be used in the following examples mean part or parts by weight and % by weight unless expressly noted. Physical properties and properties in the following Examples and Comparative Examples were determined and evaluated in accordance with the following respective methods.

(1) Volume Average Particle Diameter (Dv) and Particle Diameter Distribution (Dv/Dp):

The volume average particle diameter Dv and particle diameter distribution represented by a ratio Dv/Dp of the volume average particle diameter Dv to the number average particle diameter Dp of a toner (including the core-shell type) were measured by means of a MULTISIZER (manufactured by Coulter Co.). The measurement by the MULTISIZER was conducted under conditions of an aperture diameter=100 μm, a medium=Isothone II, a concentration=10% and the number of particles measured=50,000 particles.

(2) Average Circularity:

The average circularity of a toner is a value obtained by measurement in an aqueous dispersion system using a flow particle image analyzer "FPIA-1000" manufactured by TOA Medical Electronics Co., Ltd.). As a measuring method, 10 ml of ion-exchanged water is provided in a container in advance, a surfactant (preferably, alkylbenzenesulfonic acid salt) is added as a dispersing agent into the water, and 0.02 g of a sample to be measured is then added to uniformly disperse the sample. As a dispersing means, an ultrasonic dispersing machine was used to conduct a dispersing treatment for 3 minutes at 60 W. The concentration of the toner particles upon the measurement was adjusted to 3,000 to 10,000 particles/μl to measure circularities as to 1,000 to 10,000 particles. An average circularity was found from the measured values.

(3) Apparent Viscosity:

The apparent viscosities of a sample at 95 to 140° C. were measured under the following conditions by means of a flow tester (manufactured by Shimadzu Corporation, CFT-500C). Initial temperature=40° C., heating rate=6° C./min, preheating time=5 minutes, cylinder pressure=20.0 kg·f/cm$^2$, die diameter=1.0 mm, die length=1.0 mm, and amount of sample charged=1.0 to 1.3 g.

(4) Content of Volatile Organic Compound:

A content of volatile organic compounds was determined in accordance with the purge & trap/gas chromatography (P&g/GC) method described below.

In a purging container was placed 0.1 g of a toner, and the purging container was heated from room temperature at a rate of 10° C./min while introducing helium gas as a carrier gas at a flow rate of 50 ml/min. The container was held for 30 minutes at a temperature of 30° C., and a volatile component generated was collected in a trap tube at −130° C. After the collection, the temperature of the purging container was returned to room temperature. The trap tube, in which the volatile component had been collected, was then heated from −130° C. to 280° C. at a rate of 50° C./min to conduct determination of the volatile component under the following conditions by means of gas chromatography, thereby determining the content of volatile organic compounds.

A gas chromatograph 6890 (FID method) manufactured by Agilent Co., a Shimadzu chromatopack C-R7A, a TDS (purge & trap sampler) manufactured by Agilent Co., and a column (manufactured by J&W Co., DB-5; L=30 m, I.D=0.32 mm; film=0.25 μm) were used to conduct the measurement under the following conditions.

Column temperature: 50° C. (held for 2 minutes) to 270° C. (heated at a rate of 10° C./min), Sample charging temperature: 280° C., Detection temperature: 280° C., Carrier gas: helium gas, flow rate: 1 ml/min.

(5) Fixing Temperature and Hot Offset:

A commercially available printer (manufactured by BROTHER INDUSTRIES, LTD., HL-1240)) for non-magnetic one-component was modified in such a manner that an unfixed image can be taken out. A solid image was printed in such a manner that a toner is placed in an amount of 0.4 to 0.5 mg/cm$^2$ on paper. This printing was conducted repeatedly with 4 color toners on the same paper to obtain an unfixed image with the 4 color toners superimposed on one another.

The modified printer was modified in such a manner that paper is passed through at 151 mm/sec (corresponding to a 24 paper sheets per minute printer), and the temperature of a fixing roll can be varied, thereby conducting a fixing test at intervals of 10° C. from 170° C. to 210° C.

With respect to the fixed image, a width of the toners peeled was measured by folding the paper at the image-printed portion (solid patch portion) with hands and then opening the paper to rub the image-printed portion with a finger. A temperature, at which the width of the toners peeled was 1 mm or shorter, was regarded as a fixing temperature.

In the above-described fixing test, a temperature of the fixing roll, at which a toner was fusion-bonded to the fixing roll, was regarded as a hot offset-occurring temperature. The description of ">210" in the following Table indicates that no hot offset occurred even at 210° C.

Toner Preparation Example 1

In a media type stirring machine, 78 parts of styrene and 22 parts of n-butyl acrylate as monovinyl monomers, and 6 parts of C.I. Pigment Yellow 74 (product of Sanyo Color Works, Ltd., trade name "FAST YELLOW 7415") and 1 part of C.I. Pigment Yellow 74 (product of Sanyo Color Works, Ltd., trade name "FAST YELLOW 7416") as colorants were dispersed, and 0.5 part of a polymethacrylic ester macromonomer (product of Toagosei Chemical Industry Co., Ltd., trade name "AA6", Tg=94° C.) as a macromonomer, 0.7 part of divinylbenzene as a crosslinkable monomer, 0.5 part of t-dodecylmercaptan (TDM) and 0.5 part of tetraethylthiuram disulfide (TETD) as molecular weight modifiers, 0.8 part of a charge control resin (product of Fujikura Kasei Co., Ltd., trade name "FCA-161P") and 8 parts of polyglycerol behenate (product of Nippon Oil & Fats Co., Ltd., trade name "WEP-7", maximum endothermic peak temperature: 71° C.) as a parting agent were then added to prepare a polymerizable monomer composition.

On the other hand, an aqueous solution with 6.3 parts of sodium hydroxide (alkali metal hydroxide) dissolved in 56.7 parts of ion-exchanged water was gradually added to an aqueous solution with 11 parts of magnesium chloride (water-soluble polyvalent metal salt) dissolved in 280 parts of ion-exchanged water under stirring to prepare a dispersion liquid of magnesium hydroxide colloid (colloid of hardly water-soluble metal hydroxide).

After the polymerizable monomer composition was poured into the dispersion liquid of magnesium hydroxide colloid prepared above, and the resultant mixture was stirred, 5 parts of a peroxy ester (product of AKZO NOBEL CO., trade name "TORIGONOX 27", purity: 98%, molecular weight: 188, 1-hour half-life temperature: 94° C., 10-hour half-life temperature: 75° C.) as a polymerization initiator was further poured, and the mixture was stirred for 10 minutes at 15,000 rpm under high shearing force by means of an in-line type emulsifying and dispersing machine (manufactured by Ebara Corporation, trade name "MILDER") to form droplets of the polymerizable monomer composition.

The dispersion liquid with the droplets of the polymerizable monomer composition dispersed therein was poured into a reactor equipped with an agitating blade and heated to 90° C. to conduct a polymerization reaction. After a conversion into a polymer reached almost 100%, 1 part of methyl methacrylate as a polymerizable monomer for shell and 0.1 part of 2,2'-azobis[2-methyl-N-(2-hydroxyethyl)propionamide] (product of Wako Pure Chemical Industries, Ltd., trade name "VA086") dissolved in 10 parts of ion-exchanged water were added while keeping the polymerization temperature intact to continue the polymerization for 3 hours at 90° C. Thereafter, a stripping treatment was conducted with nitrogen gas. The polymerization reaction mixture was cooled with water to obtain an aqueous dispersion liquid containing colored polymer particles having a core-shell structure. The pH of the aqueous dispersion liquid thus obtained was 9.5.

While stirring the above-obtained aqueous dispersion liquid, sulfuring acid was added until the pH of the aqueous dispersion liquid was lowered to 6 or lower, and stirring was conducted at 25° C. for 10 minutes to conduct acid washing. After water was then separated by filtration, 500 parts of ion-exchanged water was newly added to form a slurry again, and the slurry was stirred for 10 minutes to conduct water washing. After filtration, dehydration and water washing were repeated several times, colored polymer particles were separated by filtration to obtain wet colored polymer particles. The wet colored polymer particles were placed in a dryer and dried at a temperature of 40° C. for 3 days. The volume average particle diameter of the colored polymer particles after the drying was 8.4 μm, and the average circularity thereof was 0.976.

Into 100 parts of the colored polymer particles obtained above were added 1 part of fine silica particles (product of Cabot Co., trade name "TG820F") subjected to a hydrophobicity-imparting treatment and 1 part of fine silica particles (product of Nippon Aerosil Co., Ltd., trade name "NEA50") subjected to a hydrophobicity-imparting treatment, and these components were mixed by means of a Henschel mixer to prepare "Yellow Toner Y1". The results are shown in Table 1.

Toner Preparation Example 2

"Magenta Toner M1" was prepared in the same manner as in Toner Preparation Example 1 except that the monovinyl monomers were changed to 76 parts of styrene and 24 parts of n-butyl acrylate, the colorant was changed to 5.5 parts of a magenta pigment (product of Fuji Pigment Co., Ltd., trade name "FUJI FAST CARMINE 528-1") composed of C.I. Pigment Magenta 150 and C.I. Pigment Magenta 31, the crosslinkable monomer was changed to 0.5 part of divinylbenzene, the molecular weight modifiers were changed to 0.3 part of t-dodecylmercaptan and 0.5 part of tetraethylthiuram disulfide (TETD), and the amount of the charge control resin (product of Fujikura Kasei Co., Ltd., trade name "FCA-161P") was changed to 1.5 parts. The results are shown in Table 1.

Toner Preparation Example 3

"Cyan Toner C1" was prepared in the same manner as in Toner Preparation Example 1 except that the monovinyl monomers were changed to 76 parts of styrene and 24 parts of n-butyl acrylate, the colorant was changed to 5.0 parts of C.I. Pigment Blue 15 (product of Dainippon Ink & Chemicals, Incorporated, trade name "FASTOGEN BLUE GCTF"), the crosslinkable monomer was changed to 0.5 part of divinylbenzene, the molecular weight modifiers were changed to 1.0 part of t-dodecylmercaptan and 0.5 part of tetraethylthiuram disulfide (TETD), and the amount of the charge control resin (product of Fujikura Kasei Co., Ltd., trade name "FCA-161P") was changed to 0.5 parts. The results are shown in Table 1.

Toner Preparation Example 4

"Black Toner K1" was prepared in the same manner as in Toner Preparation Example 1 except that the monovinyl monomers were changed to 76 parts of styrene and 24 parts of n-butyl acrylate, the colorant was changed to 7 parts of carbon black (product of Mitsubishi Chemical Corporation, trade name "#25B"), the crosslinkable monomer was changed to 0.6 part of divinylbenzene, the molecular weight modifiers were changed to 0.5 part of t-dodecylmercaptan and 0.5 part of tetraethylthiuram disulfide (TETD), and the amount of the charge control resin (product of Fujikura Kasei Co., Ltd., trade name "FCA-161P") was changed to 1.0 part. The results are shown in Table 1.

Toner Preparation Example 5

"Yellow Toner Y2" was prepared in the same manner as in Toner Preparation Example 1 except that the molecular weight modifiers were changed to only 0.9 part of t-dodecylmercaptan. The results are shown in Table 1.

Toner Preparation Example 6

"Magenta Toner M2" was prepared in the same manner as in Toner Preparation Example 2 except that the molecular weight modifiers were changed to only 1.0 part of t-dodecylmercaptan. The results are shown in Table 1.

Toner Preparation Example 7

"Cyan Toner C2" was prepared in the same manner as in Toner Preparation Example 3 except that the molecular weight modifiers were changed to only 1.3 parts of t-dodecylmercaptan. The results are shown in Table 1.

Toner Preparation Example 8

"Black Toner K2" was prepared in the same manner as in Toner Preparation Example 4 except that the molecular weight modifiers were changed to only 1.0 part of t-dodecylmercaptan. The results are shown in Table 1.

TABLE 1

| | Y1 | M1 | C1 | K1 | Y2 | M2 | C2 | K2 |
|---|---|---|---|---|---|---|---|---|
| ST/BA/DVB (core) | 78/22.0.7 | 76/24/0.5 | 76/24/0.5 | 76/24/0.6 | 78/22/0.7 | 76/24/0.5 | 76/24/0.5 | 76/24/0.6 |
| MMA (shell) | 0.7 | 0.7 | 0.7 | 0.7 | 0.7 | 0.7 | 0.7 | 0.7 |

TABLE 1-continued

| | Y1 | M1 | C1 | K1 | Y2 | M2 | C2 | K2 |
|---|---|---|---|---|---|---|---|---|
| Molecular weight modifier | | | | | | | | |
| TDM | 0.5 | 0.3 | 1.0 | 0.5 | 0.9 | 1.0 | 1.3 | 1.0 |
| TETD | 0.5 | 0.5 | 0.5 | 0.5 | 0 | 0 | 0 | 0 |
| Charge control resin | 0.8 | 1.5 | 0.5 | 1.0 | 0.8 | 1.5 | 0.5 | 1.0 |
| Parting agent | WEP-7 | WEP-7 | WEP-7 | WEP-7 | WEP-7 | WEP-7 | WEP-7 | WEP-7 |
| Apparent viscosity at 105° C. (Pa · s) | 80,000 | 120,000 | 120,000 | 150,000 | 103,000 | 200,000 | 200,000 | 240,000 |
| Apparent viscosity at 130° C. (Pa · s) | 9,600 | 11,000 | 11,000 | 13,000 | 20,000 | 23,000 | 23,000 | 30,000 |
| Maximum peak temperature between 105 and 130° C. (° C.) | — | — | — | — | 120 | 120 | 120 | 125 |
| Maximum value of [log value of curve B] − [log value of line A] | — | — | — | — | 0.28 | 0.25 | 0.25 | 0.20 |
| Volume average particle diameter (μm) | 8.4 | 8.0 | 8.0 | 8.2 | 8.2 | 8.1 | 8.1 | 7.9 |
| Average circularity | 0.976 | 0.974 | 0.974 | 0.976 | 0.980 | 0.976 | 0.976 | 0.976 |
| Content of volatile organic compounds (ppm) | 52 | 47 | 47 | 95 | 42 | 53 | 53 | 102 |

Example 1

The modified printer (manufactured by BROTHER INDUSTRIES, LTD., HL-1240)) for non-magnetic one-component was used to conduct full-color printing in such a manner that "Yellow Toner Y2" prepared in Toner Preparation Example 5 is arranged at the outermost layer among 4 color toners transferred to transfer paper, and "Magenta Toner M1", "Cyan Toner C1" and "Black Toner K1" are successively arranged in that order at lower layers than the outermost layer. As a result, excellent low-temperature fixing ability was achieved as demonstrated by a fixing temperature of 170° C., and moreover excellent offset resistance was exhibited as demonstrated by a hot offset temperature exceeding 210° C.

Comparative Example 1

Full-color printing was conducted in the same manner as in Example 1 except that the printing was changed in such a manner that "Yellow Toner Y1" prepared in Toner Preparation Example 1 is located at the outermost layer. As a result, excellent low-temperature fixing ability was achieved as demonstrated by a fixing temperature of 170° C., but offset resistance was insufficient as demonstrated by a low hot offset temperature of 190° C.

Comparative Example 2

Full-color printing was conducted in the same manner as in Example 1 except that the printing was changed in such a manner that "Yellow Toner Y2" prepared in Toner Preparation Example 5 is arranged at the outermost layer, and "Magenta Toner M2", "Cyan Toner C2" and "Black Toner K2" are successively arranged in that order at lower layers than the outermost layer. As a result, excellent offset resistance was exhibited as demonstrated by a hot offset temperature exceeding 210° C., but low-temperature fixing ability was insufficient as demonstrated by a high fixing temperature of 190° C.

TABLE 2

| | Example 1 | | | | Comparative Example 1 | | | | Comparative Example 2 | | | |
|---|---|---|---|---|---|---|---|---|---|---|---|---|
| | Y (outermost layer) Y2 | M M1 | C C1 | K K1 | Y Y1 | M M1 | C C1 | K K1 | Y (outermost layer) Y2 | M M2 | C C2 | K K2 |
| Use of molecular weight modifier TETD | Not used | Used | Used | Used | Used | Used | Used | Used | Not used | Not used | Not used | Not used |
| Fixing temperature (° C.) | | 170 | | | | 170 | | | | 190 | | |
| Hot offset temperature (° C.) | | >210 | | | | 190 | | | | >210 | | |

INDUSTRIAL APPLICABILITY

According to the present invention, there can be provided a process for forming a full-color image by an electrophotographic system or an electrostatic printing system making use of a black toner, a cyan toner, a magenta toner and a yellow toner, by which both low-temperature fixing ability and hot offset resistance are made excellent.

The image forming process according to the present invention can be used as a process for forming a full-color image by an electrophotographic system or an electrostatic printing system.

What is claimed is:

1. A process for forming a full-color image, comprising the following steps:

a development step of using 4 color toners of a black toner, a cyan toner, a magenta toner and a yellow toner to develop an electrostatic latent image corresponding to each color on one or more photosensitive members at every color, thereby forming toner images of the respective colors;

a transfer step of transferring the toner images of the respective colors to one transfer medium to form a toner image with the 4 color toners superimposed on one another on the transfer medium; and a fixing step of fixing the toner image formed on the transfer medium, wherein the 4 color toners comprise colored resin particles containing a binder resin, a colorant corresponding to each color and a parting agent and have an apparent viscosity at 105° C. of 50,000 to 300,000 Pa·s and an apparent viscosity at 130° C. of 3,000 to 30,000 Pa·s, and wherein as a color toner arranged at the outermost layer of the toner image with the 4 color toners superimposed on one another on the transfer medium among the 4 color toners, a toner, in which a maximum peak or a shoulder peak is present between 105° C. and 130° C. in a temperature-logarithmic melt viscosity graph, is used, and as the other 3 color toners arranged at lower layers than the outermost layer, toners, in which neither the maximum peak nor the shoulder peak is present between 105° C. and 130° C., are used.

2. The full-color image forming process according to claim 1, wherein the 4 color toners comprise colored resin particles having a volume average particle diameter of 3 to 12 μm.

3. The full-color image forming process according to claim 1, wherein the 4 color toners comprise colored resin particles having an average circularity of 0.960 to 0.995.

4. The full-color image forming process according to claim 1, wherein the parting agent is a fatty acid ester compound of a polyhydric alcohol.

5. The full-color image forming process according to claim 1, wherein the 4 color toners comprise colored resin particles having a volatile organic compound content of at most 500 ppm.

6. The full-color image forming process according to claim 1, wherein the colored resin particles making up each of the 4 color toners are colored polymer particles.

7. The full-color image forming process according to claim 1, wherein the 4 color toners are each a core-shell type toner that a coating resin layer is formed on each surface of the colored resin particles.

8. A full-color image forming process, comprising the following steps:

a development step of using 4 color toners of a black toner, a cyan toner, a magenta toner and a yellow toner to develop an electrostatic latent image corresponding to each color on one or more photosensitive members at every color, thereby forming toner images of the respective colors;

a transfer step of transferring the toner images of the respective colors to one transfer medium to form a toner image with the 4 color toners superimposed on one another on the transfer medium; and a fixing step of fixing the toner image formed on the transfer medium, wherein the 4 color toners comprise colored resin particles containing a binder resin, a colorant corresponding to each color and a parting agent and have an apparent viscosity at 105° C. of 50,000 to 300,000 Pa·s and an apparent viscosity at 130° C. of 3,000 to 30,000 Pa·s, and wherein as a color toner arranged at the outermost layer of the toner image with the 4 color toners superimposed on one another on the transfer medium among the 4 color toners, a toner, in which a maximum peak or a shoulder peak is present between 105° C. and 130° C. in a temperature-logarithmic melt viscosity graph, is used, and as the other 3 color toners arranged at lower layers than the outermost layer, toners, in which neither the maximum peak nor the shoulder peak is present between 105° C. and 130° C., are used, wherein an apparent viscosity of a toner sample is measured within a temperature range of 95 to 140° C. by means of a flow tester to prepare a temperature-logarithmic melt viscosity graph plotting the resultant measured values on a graph that the logarithm of the apparent viscosity and the temperature are taken on an axis of ordinate and an axis of abscissa, respectively, from a straight line A linking a melt viscosity value at 105° C. with a melt viscosity value at 130° C. of the toner in the range of 105 to 130° C. in the temperature-logarithmic melt viscosity graph and a curve B exhibited by the toner, a maximum value of a difference between the log(melt viscosity Pa·s) of the curve B and the log(melt viscosity Pa·s) of the straight line A is determined, and a toner that the maximum value is at least 0.1 is used as the color toner arranged at the outermost layer of the toner image with the 4 color toners superimposed on one another on the transfer medium.

9. The full-color image forming process according to claim 8, wherein a gradient of the straight line A is at most −0.06.

10. The full-color image forming process according to claim 1, wherein the color toner arranged at the outermost layer is prepared without using tetraethylthiuram disulfide, wherein the other 3 color toners arranged at lower layers are prepared by using tetraethylthiuram disulfide.

* * * * *